US008348627B2

(12) United States Patent
Rampen et al.

(10) Patent No.: US 8,348,627 B2
(45) Date of Patent: Jan. 8, 2013

(54) DIGITAL HYDRAULIC PUMP/MOTOR TORQUE MODULATION SYSTEM AND APPARATUS

(75) Inventors: William Hugh Salvin Rampen, Lothian (GB); Uwe Bernhard Pascal Stein, Lothian (GB); Michael Richard Fielding, Edinburgh (GB); Niall Caldwell, Edinburgh (GB)

(73) Assignee: Artemis Intelligent Power Ltd, Midlothian (GB)

( * ) Notice: Subject to any disclaimer, the term of this patent is extended or adjusted under 35 U.S.C. 154(b) by 909 days.

(21) Appl. No.: 12/309,697

(22) PCT Filed: Jul. 27, 2007

(86) PCT No.: PCT/GB2007/050457
§ 371 (c)(1),
(2), (4) Date: Jan. 27, 2009

(87) PCT Pub. No.: WO2008/012587
PCT Pub. Date: Jan. 31, 2008

(65) Prior Publication Data

US 2009/0317266 A1 Dec. 24, 2009

(30) Foreign Application Priority Data

Jul. 27, 2006 (GB) ..... 0614940.5

(51) Int. Cl.
*F04B 47/12* (2006.01)

(52) U.S. Cl. ..... 417/57; 417/38; 417/139; 60/706; 60/708; 91/474; 91/476; 91/497

(58) Field of Classification Search ..... 417/57, 417/36–41, 107, 139; 60/701, 703, 706–711; 91/474, 476, 497
See application file for complete search history.

(56) References Cited

U.S. PATENT DOCUMENTS 4,321,014 A 3/1982 Eburn, Jr. et al.

FOREIGN PATENT DOCUMENTS

| | | |
|---|---|---|
| EP | 0 084 070 | 7/1983 |
| EP | 0 102 780 | 3/1984 |
| EP | 0 361 927 | 4/1990 |
| EP | 0 494 236 | 7/1992 |
| EP | 1 319 836 | 6/2003 |
| WO | WO 2005/106248 | 11/2005 |
| WO | WO 2006/055978 | 5/2006 |

OTHER PUBLICATIONS

Machine translation of WO 2005106248.*
International Search Report for PCT/GB2007/050457, mailed Mar. 14, 2008.

* cited by examiner

*Primary Examiner* — Anne Hines
*Assistant Examiner* — Jose M Diaz
(74) *Attorney, Agent, or Firm* — Nixon & Vanderhye, PC

(57) ABSTRACT

The present invention provides a hydraulic pump for use in driving a load with a control modulation system which modulates a primary control signal in order to accommodate variations in secondary changeable parameters which require control at a higher frequency or have a lower latency.

31 Claims, 5 Drawing Sheets

DIGITAL HYDRAULIC PUMP/MOTOR TORQUE MODULATION SYSTEM AND APPARATUS

This application is the U.S. national phase of International Application No. PCT/GB2007/050457, filed 27 Jul. 2007, which designated the U.S. and claims priority to Great Britain Application No. 0614940.5, filed 27 Jul. 2006, the entire contents of each of which are hereby incorporated by reference.

FIELD OF INVENTION

The present invention relates to a hydraulic pump or motor having control of individual working chambers driving a load and relates particularly, but not exclusively, to an arrangement where the torque provided to that load may be varied rapidly.

BACKGROUND TO THE INVENTION

One example of the above-mentioned pump/motor arrangement resides in the hydraulic drive of vehicle wheels in both on-road and off-road applications. Such arrangements have been the subject of much prior activity and the transmissions employed therewith comprise one or more fixed or variable-displacement hydraulic motors at individual wheels or alternatively motors positioned to drive groups of wheels.

In the most common positive displacement hydraulic machines the fluid chambers undergo cyclical variations in volume following a roughly sinusoidal function. It is known from EP0361927 that a chamber can be left to idle by holding an electromagnetically actuated valve, between the working chamber and the low-pressure source, in the open condition. Thus the output is varied through the action of first filling each working chamber with liquid, then deciding whether to reject the liquid back to the low-pressure source or to pump it at pressure to the output manifold. Pumping the liquid back to the low-pressure source means that a very small amount of power needs to be expended, during the time that a working chamber is idle, whilst still allowing the working chambers to become productive with a minimum latency period.

EP0494236 introduces an additional operating mode which allows the use of the hydraulic machine in a motoring cycle where torque is applied to the rotating shaft, thus allowing a controllable bi-directional energy flow. This type of motor has until now been limited to a control bandwidth and latency of half a shaft revolution, which for example is 17 Hz at 500 RPM, because whole cylinders are selected. However, there are a number of applications where high frequency torque adjustments could offer new and desirable capabilities.

This present invention provides a way of controlling hydraulic motors so as to modulate the output torque at frequencies of up to around 200 Hz and may lend itself to application in a number of fields, some of which are described in detail below by way of background information:

Vehicle Traction Control Systems

An increasingly common requirement in automotive drivelines is that the torque at individual wheels or groups of wheels (for example, rear axle, front axle) must be able to be modulated in both the braking and accelerating modes in order to limit wheel slip. This requirement is due to two factors. Firstly, slipping wheels do not allow the driver to maintain directional control of the vehicle and generally provide less decelerating or accelerating force than wheels that are not slipping. Secondly, the point at which individual wheels or groups of wheels start to slip is different from one another even contemporaneously on an individual vehicle. Slippage is determined by wheel or axle loading, weight transfer during braking and cornering, and the road surface conditions that may be different for different wheels.

Typically in vehicles with a conventional mechanical transmission between engine and wheels the torque modulation is achieved through the momentary application of the friction brakes to one or more wheels, under the control of a central vehicle stability controller. The controller typically takes as its inputs individual wheel speeds, vehicle angular acceleration rates, accelerator pedal position and steering wheel angle, and uses that to modulate the brakes. This system is typically called Antilock Braking System (ABS) when it operates only when braking, or Electronic Stability Control (ESC) when it operates in both braking and accelerating and includes sensors for vehicle movement and acceleration so as to control yaw. As well as applying the friction brakes, the engine torque may be reduced through the use of ignition retarding or interruption, reducing the fuelling rate or adjusting the throttle position.

Other systems exist to vary the distribution of torque to several driveshafts under electronic control. One such system is the E-Diff or Electronic Differential that uses electrohydraulically-actuated friction clutches to distribute torque between two or more driveshafts.

It is essential in all systems that the torque modulation is rapid so as to maintain the optimum slip rate for traction as much as possible. Typical bandwidths are around 10 Hz. ABS brakes, for example, are known to operate at up to 13 Hz. This is not generally high enough to maintain the wheels in the optimal slip condition (generally considered to be about 5-10% slip), but high enough to keep them oscillating between slipping and not slipping.

Electrical Generators

Another application where high torque control bandwidth is desirable is in the driving of electric generators. In this application one or more hydraulic motor(s) may drive one or more synchronous generator(s) for electrical supply to the distribution grid or an isolated power network. The shaft speed of these machines is linked to the AC voltage of the network. The modulation of shaft torque causes a near-instantaneous modulation of the generator current Harmonic distortion of the current taken by loads on electrical grid, commonly caused by loads such as electronic equipment power supplies, is a high frequency intra-cycle variation from the intended sinusoidal wave, causing a corresponding high frequency intra-cycle variation of required shaft torque. By modulating the torque applied by the hydraulic motor to the generator at high enough frequencies, the current supplied to the grid can be modulated (without requiring complex power electronics) thereby helping to restore the voltage waveform to the required state. This capability also requires accurate control of the phase of the corrections with respect to the generator (and therefore hydraulic motor) shaft.

A separate problem is that the frequency of the AC voltage may start to deviate above or below the desired frequency due to a short term or sudden mismatch between the grid load and grid supply, for example when a new load is turned on or off. In the case that the a load is turned off, the frequency increases above the desired frequency. Reducing the generator torque reduces the power output and restores the correct frequency. If the generator torque can be modulated quickly enough then even very sudden load changes can be accommodated without a change to the grid frequency.

Energy Conversion

A further application where high torque control bandwidth is desirable is when a shaft is driving or being driven from a structure with a large mass that may suffer from vibratory resonances, for example a wind or tidal turbine. If the structure is excited with a torque load having a frequency matching a resonant frequency of the structure, damage to the shaft, attached machines, and the structure may result. By the correct control of the shaft torque at high enough frequency the resonances can be avoided, or eliminated if they have already begun.

From the above it will be appreciated that there are numerous applications in which rapid changes in output torque or power delivery are essential control requirements and many of these fail to employ hydraulic pump/motor arrangements due to their inability to provide adequate control. It is, therefore, an object of the present invention to provide a method of and apparatus for modulating the fluid output from a hydraulic pump/motor which is able to respond rapidly to changes in demand and which may also allow hydraulic pump/motors to be employed in control applications that they have hitherto been excluded from.

According to the present invention there is provided a hydraulic pump/motor with a plurality of cylinders each with a low pressure and high pressure actuated poppet valve under the control of a controller, where the controller is able to provide a sequence of signals to the valves in a phased relationship with the pump/motor shaft so as to effect either a pumping or motoring cycle but has the added capability to modify individual high pressure valve signals in the sequence to lengthen, shorten or adjust the time that the valves remain open, and so to provide for modulation of the pump/motor's torque output.

According to one aspect, the present invention provides: a method of controlling a fluid working machine having: one or more working chambers of cyclically varying volume; one or more inlet valves; one or more outlet valves; a rotating shaft driven by or driving a load; and a controller for receiving data on a first changeable parameter and controlling the operating and closing sequence of said valves to selectively enable said working chamber separately on each of the expansion and contraction strokes of said chamber, so as to supply or accept fluid in accordance with said first changeable parameter, the method comprising the steps of: monitoring a second changeable parameter requiring control at a higher frequency or having a lower latency than said first changeable parameter; and modifying the valve actuation to supply or accept fluid demand in accordance with a combination of said first and said second changeable parameter.

According to a further aspect of the present invention there is provided a fluid working machine having: one or more working chambers of cyclically varying volume; one or more inlet valves; one or more outlet valves; a rotating shaft driven by or driving a load; a controller, for receiving data on a first changeable parameter and controlling the opening and closing sequence of said valves able to selectively enable said individual working chambers separately on each of the expansion and contraction strokes of said chambers, so as to supply or accept fluid in accordance with said first changeable parameter, a monitor, for monitoring a second changeable parameter requiring control at a higher frequency or having a lower latency than said first changeable parameter; wherein said controller monitors said second changeable parameter and modifies the valve actuation to supply or accept fluid demand in accordance with a combination of said first and said second changeable parameter.

DESCRIPTION OF THE DRAWINGS

The present invention will now be more particularly described, by way of example only, with reference to the accompanying drawings, in which.

DESCRIPTION OF THE PRESENT INVENTION

Figure 1:
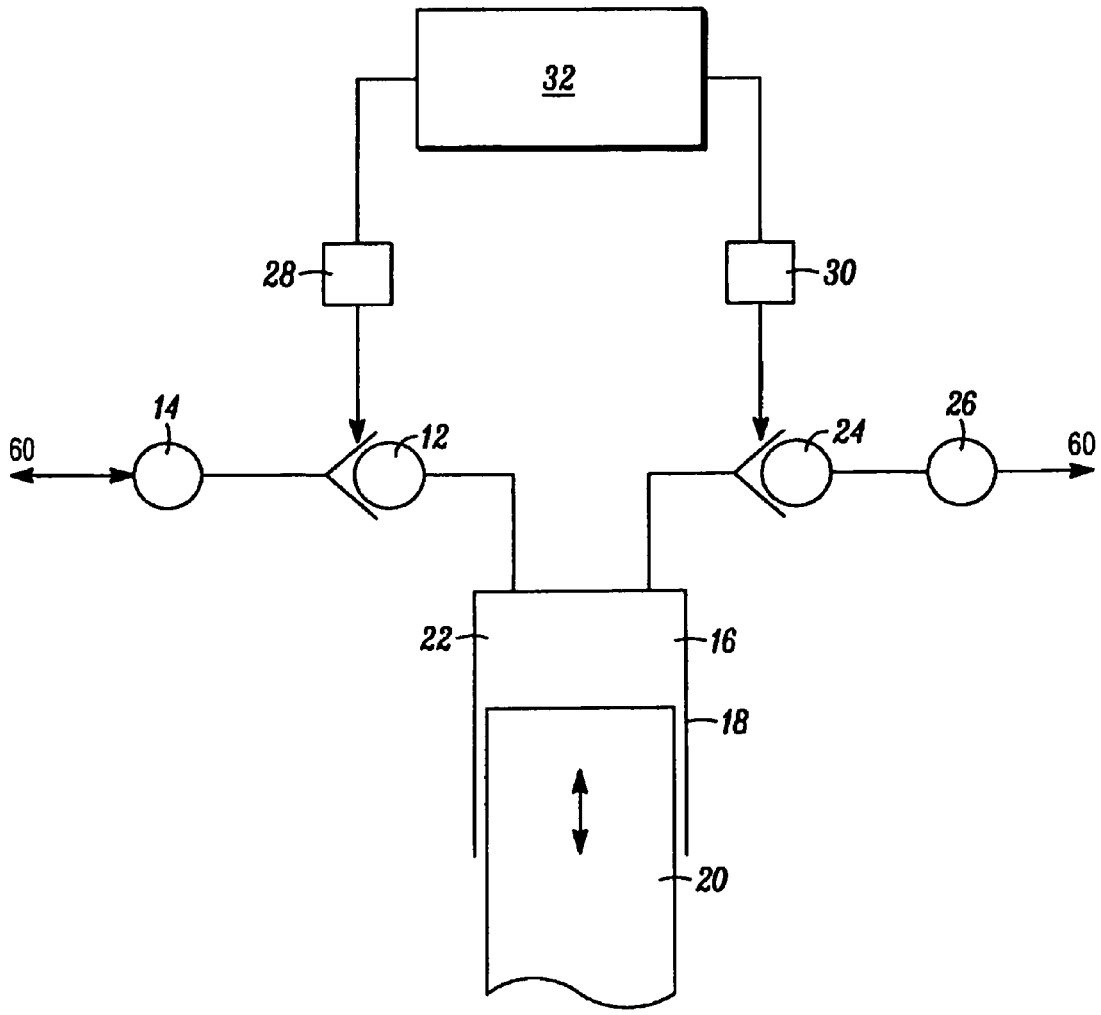
FIG. 1 illustrates a simple Digital Displacement pump arrangement.

Referring now to the drawings in general but particularly to FIG. 1, which illustrates a machine 10 comprising a first face-seating valve 12 interposed between a low-pressure manifold or tank 14 and a working chamber 16 defined by cylinder 18 and piston 20 and having a cyclically varying volume 22 the use of which will be described in detail later herein. A second face-seating valve 24 is provided interposed between the working chamber 16 and a high-pressure manifold 26. The valves 12 and 24 are preferably of the poppet type, each of which may be actuated by means of solenoid actuators shown diagrammatically at 28 and 30 respectively. The valves 12, 24 may be arranged such that any pressure from within the cylinder holds the first valve 12 closed whilst any pressure from the high pressure manifold 26 holds the second valve 24 closed. Other arrangements will, however, present themselves to those skilled in the art and the present invention is not considered to be limited to such arrangements. The arrangement further includes a controller 32 linked to said first and second valve actuators 28, 30 by means of control lines 34 and 36 so as to enable functional control of the valves in accordance with a desired control strategy discussed in detail later herein. A sensor 38 is provided for sensing a first changeable parameter according to which it is desired to control the machine by modifying the output of the machine so as to accept or reject fluid quanta in a manner which is described in more detail later herein.

The above pump/motor or fluid working machine 10 has three modes of operation namely: idling, motoring and pumping. With valve 12 in the open position, and valve 24 in the closed position the pressure in the high-pressure manifold 26 is at or above the pressure of the low-pressure manifold 14 and the pressure in the working chamber 16 equals the pressure of the low-pressure manifold. Pumping the fluid quanta taken into the working chamber back to the low-pressure manifold 14 defines the idle mode in which the fluid quanta is not employed but is merely recycled for possible future use. This stroke has a low parasitic loss as a very small amount of power needs to be expended and no useful work is done.

A motoring cycle starts by the closing of valve 12 at some point in the contraction stroke of the piston 20. With valve 12 in the closed position and valve 24 in the closed position, the pressure in the high-pressure manifold 26 and the pumping chamber 16 will equalise. For optimum motoring operation, i.e. the largest net fluid intake from the high-pressure supply, the timing of the closing of valve 12 is determined so that the equalisation happens at or shortly before Top Dead Centre of the piston motion (TDC) of the piston 20 movement. Once the pressure has equalised, valve 24 can be commanded to open such that the pumping chamber 16 is connected to the high-pressure manifold 26, and disconnected from the low-pressure manifold 14 by valve 12 so that the high-pressure fluid can act on the working chamber 16 to drive the piston 20 down and thereby producing torque on a crankshaft to which the piston is coupled (best seen in FIG. 2). Valve 24 has to be closed before the piston 20 reaches bottom-dead-centre (BDC). The remaining expansion of the working volume 22, as the working chamber 16 reaches its limit condition, will depressurise the fluid in it and allow valve 12 to open. With valve 12 in the open position and valve 24 in the closed position it is now possible to displace the fluid into the low-pressure manifold as the moves toward its top-dead-centre position.

A pumping cycle starts by the closing of valve 12 at some point in the contraction stroke of the piston 20 or at the beginning of said stroke. With valve 12 in the closed position and valve 24 in the closed position, the pressure in the high-pressure manifold 26 and the pumping chamber 16 will equalise. Once the pressure has equalised, valve 24 can be commanded to open or opens passively such that the pumping chamber 16 is connected to the high-pressure manifold 26, and disconnected from the low-pressure manifold 14 by valve 12. Valve 24 closes as the flow rate through it reaches zero at top-dead-centre (TDC), once again isolating the chamber 16 from the high-pressure manifold. The subsequent expansion of the working volume 22, as the pumping chamber 16 passes its limit condition, will depressurise the fluid in it and allow valve 12 to open. With valve 12 in the open position and valve 24 in the closed position it is now possible to intake fluid into the chamber 16 from the low-pressure manifold 14 as the pumping chamber 16 moves toward its bottom-dead-centre (BDC) position.

It will be appreciated that because the location within the cycle where the valve 12 and valve 24 open and close is under control of and therefore known by the controller, that the volume of quanta displaced into or received from the high-pressure supply in any cycle will be known.

It will further be appreciated that the above mentioned fluid quanta are equivalent to quanta of energy that can be added or subtracted to the kinetic energy of a load to which the pump/motor is connected. The amount of energy in each fluid quanta is directly related to the pressure and volume of the quanta by the equation $$E = \tfrac{1}{10} PV$$

where E is the energy in Joules, P is the pressure in Bar, and V is the volume in cubic centimetres. The speed change of an inertial load attached to the pump/motor 10 is easily worked out from the change in kinetic energy if the inertia I is known:

$$RPM_2 = \sqrt{RPM_1 + \frac{\Delta E}{\frac{1}{2}\frac{I\pi^2}{60^2}}}$$

where $RPM_1$ and $RPM_2$ are respectively the initial and final shaft speeds, ΔE is the change in energy in the shaft, and/is the rotational inertia in kg $m^2$.

Figure 2:
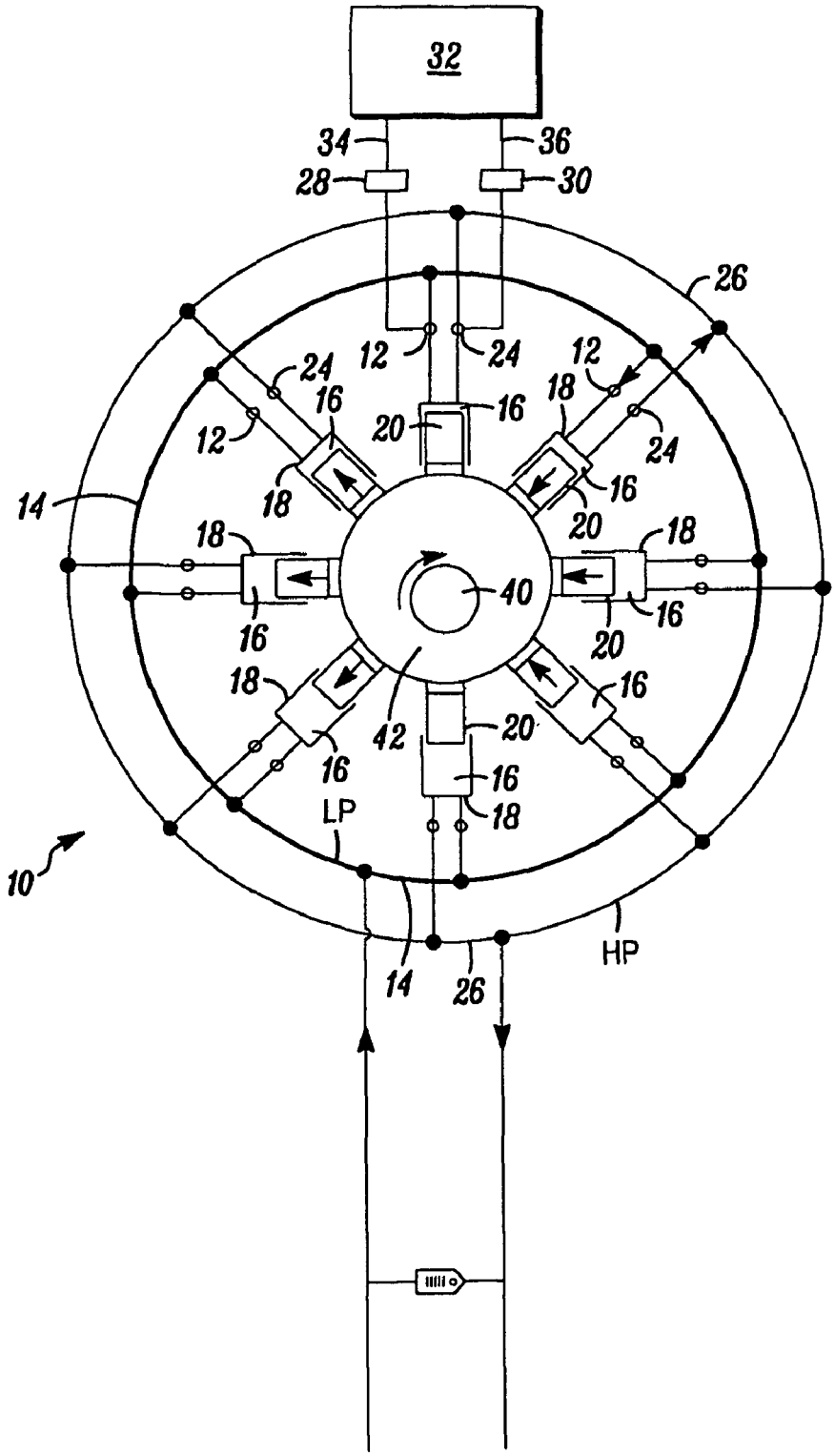
FIG. 2 illustrates a multi-chamber Digital Displacement pump.

FIG. 2 provides a multi-chamber machine 10 having a plurality of working chambers 16 positioned around a common crankshaft 40 having an eccentric cam 42 provided thereon and operable to cooperate with the pistons 20 of each working chamber 16 such as to cause rotation of said shaft 40 upon movement of the piston or cause movement of the piston upon rotation of the shaft 40. The controller 32 of FIG. 1 is replicated in FIG. 2 as are the valves 12, 24 actuators 28, 30 and manifolds 14 and 26. Each working chamber being provided with a pair of valves and actuators coupled for actuation by said controller.

Figure 3:
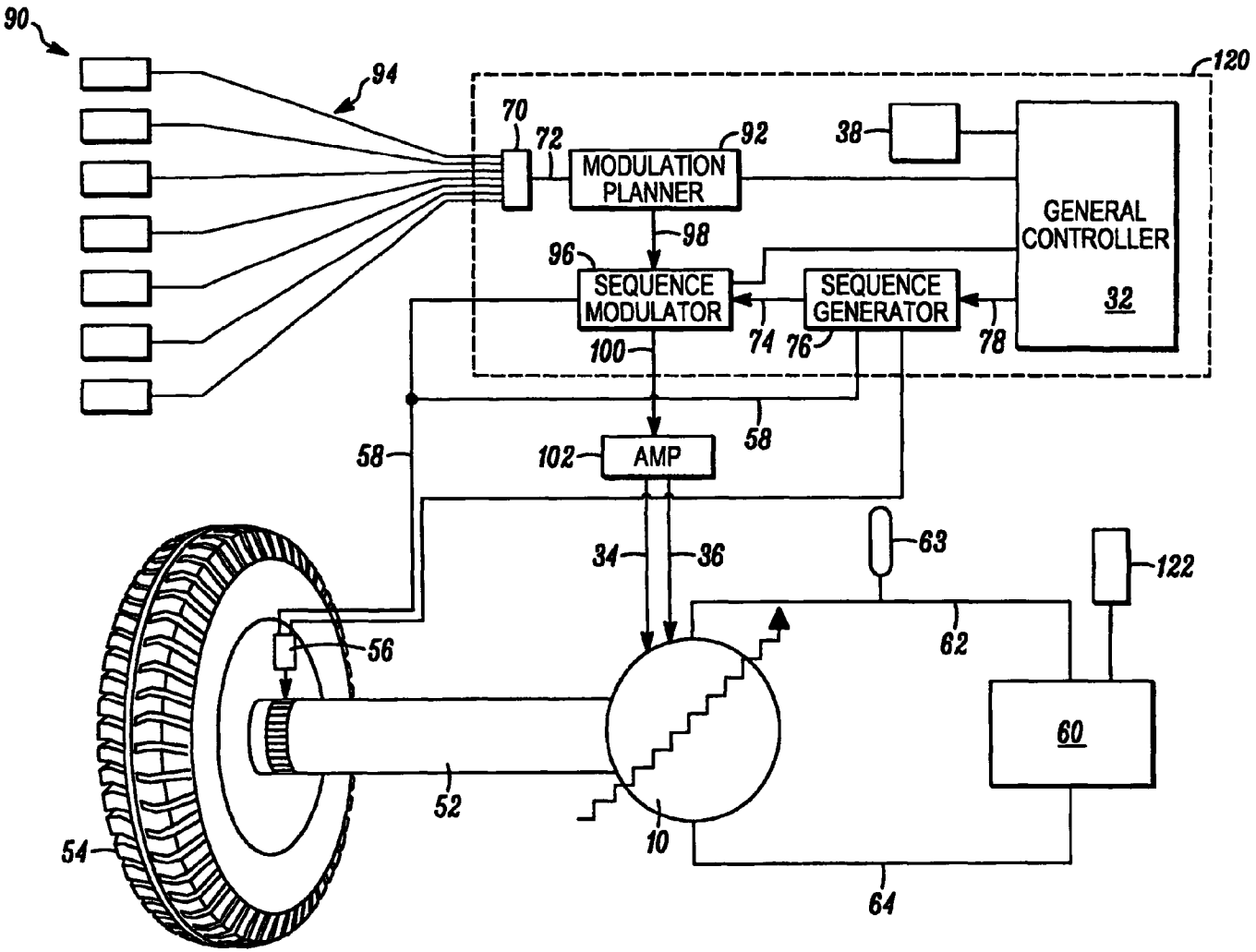
FIG. 3 illustrates a first aspect of the present invention and shows in detail the case of a single pump/motor with a torque and flow modulating mechanism.

FIG. 3 provides a single fluid working machine 10 arrangement in the form of a solenoid valve commutated pump/motor, as described above, which is connected mechanically via a shaft 52 to a load 54 in the form of, for example, a vehicle wheel, a generator or a fluid turbine. The system further includes an angular position sensor 56 coupled via data line 58 to controller 120 for the provision of data thereto and which may form the primary sensor 38 mentioned above. The fluid working machine 10 accepts or rejects the quanta of high pressure fluid from or to a fluid sink or supply, shown schematically at 60, through line 62 that may be a hydraulic hose and which may include an accumulator 63. Energy is supplied to the load 54 if the pump/motor 10 accepts a fluid pulse from the supply 60, while energy is extracted from the load 54 if the pump/motor 10 supplies a fluid pulse to the supply 60. A low pressure connection 64 returns hydraulic fluid to the fluid supply when the pump/motor 10 is in the motoring mode, or supplies the pump/motor 10 with hydraulic fluid in the pumping mode. The flow into and from each working chamber 16 of the pump/motor 10 is commutated by the solenoid actuated valves 12, 24. Each stroke of each working chamber 16 can be either a pumping, motoring or idle stroke, which are determined by appropriately timed, relative to the shaft 52 angle and speed, valve signals conveyed by the valve wiring 34, 36.

The controller is provided with a means of monitoring a first changeable parameter related to the demanded displacement of fluid from the working chambers aggregated as a whole. By means of a control strategy employing the appropriate selection of pumping, motoring or idle strokes on several chambers, the controller can achieve the demand according to the first changeable parameter by the time-averaged volume of quanta output or input from or into said chambers actually being used.

In addition to the general or first control strategy discussed above in relation to FIGS. 1 and 2, the arrangement of FIG. 3 is provided with a further degree of monitoring and control based on the determination or detection of further parameters, discussed later herein, which are important to the efficient or safe operation of the overall system but which require control at a higher frequency or lower latency than can be accommodated by fluid variation on a stroke-by-stroke basis.

The system of FIG. 3 may also be provided with additional components such as an optional predictor 70 for predicting the behaviour of the load 54 and transmitting said prediction on the load behaviour signal connection 72. The general portion of controller 32 may also communicate the fluid requirements of the pump/motor to the fluid supply 60 using the fluid supply communications channel 74. A sequence generator 76 receives the demand across a demand input connection 78 and the shaft speed and position across the shaft sensor channel, and uses both to generate the appropriate shaft phase-locked valve signals to meet the demand required by the system to control the time-averaged shaft torque or fluid flow rate through the pump/motor 10. The sequence so generated is output on the sequence channel 74.

The further degree of monitoring or control is facilitated by the provision of one or more application-specific sensors shown generally at 90 and being connected to a modulation planner 92 through sensor connections shown generally at 94. The application sensors 90 convey to the modulation planner 92 information about the load behaviour (or another physical response that is under the influence of the load) so that the modulation planner 92 can determine whether the behaviour is as was intended by the general controller 32. Where the behaviour is not as intended, the modulation planner 92 provides a modulation request to a sequence modulator 96 though a modulation request channel 98. The modulation request would normally be arranged so as to bring the load behaviour back towards the desired behaviour. The sequence modulator 96 takes the modulation request, the shaft position and speed from the shaft sensor channel 58 and the valve operating sequence from the sequence channel 74, and provides a new valve sequence according to one of the nine sequence modifying methods described below herein. The new sequence is generated in phase lock with the shaft. A modulated valve sequence channel 100 conveys the new sequence to an amplifier 102 which provides the valve signals to the solenoids 12, 24 of the pump/motor 10 through the valve wiring 34, 36.

It will be appreciated that a number of secondary sensors 90 may be provided in order to improve the control aspects of the presently described system, the sensors provided varying with the application. For example the sensors required for traction control include one or more of: steering wheel angle; yaw rate; acceleration; wheel velocity; wheel angular acceleration; wheel slip; vehicle lateral acceleration; vehicle velocity and brake line pressure. Optional additional sensors could be employed for monitoring one or more of: vehicle roll rate and acceleration; vehicle pitch rate and acceleration; braking force applied at each wheel; tyre air pressure; vehicle acceleration and deceleration; payload mass and distribution thereof. For the purposes of brevity these are shown collectively at 90.

The sensors required for generator drive include one or more of: power factor, shaft speed and torque, grid frequency, and current and voltage harmonic frequency content.

Sensors required for a machine attached to a large structure such as a wind or tidal turbine include one or more of: accelerometers for detecting blade vibration; shaft torque and speed; blade pitch; blade velocity; blade tip relative position and velocity. It will be appreciated that the various electronic control components described above may be provided in any combination within the same physical unit 120, within groups of units or as individual components, and related communication channels and connections may be provided in software.

Modulation Methods

The following describe nine ways in which the pump/motor 10 valve operations may be altered by the modulation of controller 32, 120 so as to modify the sequence of fluid quanta accepted into or rejected from the pump/motor 10. These are each shown in FIG. 4 to which the reader's attention is now drawn. In this figure, the sinusoidal line 202 represents the cyclically changing volume of the working chamber between maximum volume at Bottom Dead Centre (BDC) 206 and minimum volume at Top Dead Centre (TDC) 200 and returning to BDC 204 as time T progresses along axis 210. Accordingly, contraction regions 212 and 216 correspond to pumping operation and expansion region 214 to motoring operation.

Motoring:

1. While inducting a fluid quantum from the high pressure manifold, the signal to close the HPV at the end of the motoring stroke 222 may be delayed 224 so as to close the HPV closer to BDC 204. This will intake a larger, and predictable, quantum of fluid from the high pressure manifold than would have been the case had the intervention not been made, and produce a larger, predictable, time-averaged torque on the shaft.
2. While inducting a fluid quantum from the high pressure manifold, the signal to close the HPV at the end of the motoring stroke 230 may be delayed so as to close the HPV 232 shortly after BDC 204. The cylinder will then remain pressurised through to the end of the upstroke 216 and the LPV will not be able to open. This causes the known volume of fluid inducted from the high pressure manifold to be returned to the high pressure manifold, negating the torque pulse and fluid intake in the previous half cycle. The sequence modulator may then inhibit further motoring strokes using one of the methods described later herein, or allow the cylinder to return to normal operation.
3. While inducting a fluid quantum from the high pressure manifold, the signal to close the HPV at the end of the motoring stroke 242 may be advanced to close the HPV 240 earlier than it was intended to close by the sequence-generating controller. This will intake a smaller, and predictable, quantum of fluid from the high pressure manifold, and produce a smaller, predictable, time-averaged torque on the shaft.
4. After the LPV is closed 250 to equalise the pressure in the cylinder to that of the high pressure manifold in preparation for a motoring stroke, the sequence modulator may delete or inhibit the signal to open the HPV 252 so that no fluid is inducted from the high pressure manifold. This will exhaust a predictable quantum of fluid into the high pressure manifold and eliminate the otherwise expected intake of a fluid quantum from that manifold, also producing a predictable change in the direction and magnitude of the time-averaged torque exerted on the shaft.

Pumping:

5. While the cylinder is unpressurised during an idle stroke, a signal to close the LPV 260 can be given on the upstroke to insert an additional partial pumping cycle into the sequence. This will exhaust a predictable quantum of fluid from the cylinder into the high pressure manifold, and produce a predictable time-averaged shaft torque. (Probably need to define positive and negative).
6. While the cylinder is unpressurised, a signal to close the LPV 270 can be deleted or inhibited on the upstroke so as to remove a pumping cycle (or motoring) cycle from the sequence. This will prevent a predictable quantum of fluid from being exhausted to the high pressure manifold and a predictable time-averaged torque being applied to the shaft.
7. When the cylinder is unpressurised on the upstroke, a signal to close the LPV 274 can be advanced 272 to close the LPV earlier than it was intended to close by the sequence-generating controller. This will pump a larger, and predictable, quantum of fluid into the high pressure manifold, and produce a larger, predictable, time-averaged torque on the shaft.
8. When the cylinder is unpressurised, a signal to close the LPV 280 can be delayed 290 to close the LPV later than it was intended to close by the sequence-generating controller. This will pump a smaller, and predictable, quantum of fluid into the high pressure manifold, and produce a smaller, predictable, time-averaged torque on the shaft.
9. When the cylinder is pressurised at the end of a pumping stroke 314, a signal to retain open the HPV until some way through 312 the following expansion stroke 214 can be added 310 so that the pumping stroke intended by the sequence-generating controller is converted into a motoring stroke. This causes at least a portion of the known quantity of fluid pumped to the high pressure manifold to be returned to the working chamber with a corresponding reduction in the time averaged torque on the shaft, or alternatively an even greater known amount of fluid to be inducted from the high pressure manifold and a change in the direction as well as magnitude of the time averaged torque on the shaft, depending on the relative sizes of said pumping 212 and motoring 214 strokes.

It will now be appreciated that by using the above techniques according to the need, the modulation planner may alter the torque or flow of the pump/motor between 100% motoring and 100% pumping, regardless of the original time-averaged torque or flow commanded by the sequence generator. In the case of a response to a sudden, unexpected, condition, modulation can be achieved with a delay of typically as little as 2 milliseconds.

Communication

Because the changes to the volume of fluid quanta accepted into or rejected from the cylinder and torque applied to the shaft are predictable in each case, the sequence modulator is able to communicate electronically the effect of the sequence alteration on either fluid displacement or shaft torque to the general controller, though the modulation reporting channel. The general controller may report a different requirement to the fluid supply using the modulation reporting channel.

An important property of the modulation is that the expected size of the quantum or change in shaft torque can be determined by the sequence modulator 96 at the moment the decision to alter the sequence is made, whereas the effect itself is generally felt a small time later. This advanced knowledge would be useful because the general controller 32 and fluid supply could have enough time to change their behaviour to suit the new conditions. For example, if the sequence modulator 96 momentarily reduces the pump/motor's fluid intake, the supply 60 could momentarily reduce its fluid output so as to avoid raising the pressure in the high pressure manifold 14. The fluid supply could in fact use one of the flow modulating methods described above herein, or alternative methods.

Alternatively, the fluid supply 60 may use its own sensors to determine the fluid flow rate required to maintain a zero net flow into or out of the high pressure manifold 14. In this way the fluid supply 60 is enslaved to the pump/motor 10. The fluid supply 60 may also utilise its own sensors shown schematically at 122 to correct for small, slowly introduced, inaccuracies in the quanta information or its own inaccuracy, for example leakage of hydraulic fluid to the low pressure side 64.

Balancing of Fluid Flow

Figure 5:
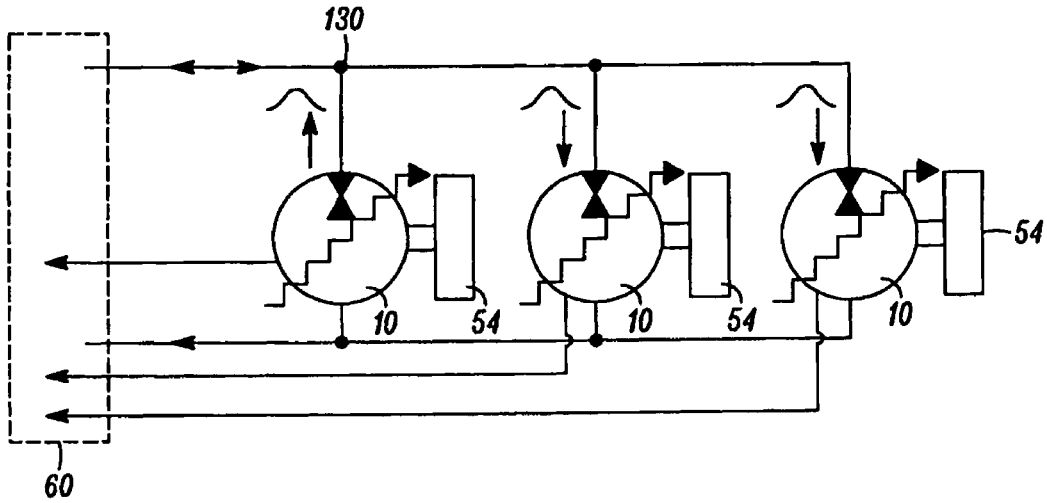
FIG. 5 shows the case of multiple pump/motors operating with independent torque or flow modulating mechanisms so as to transfer energy between them.

Referring now to FIG. 5 which illustrates the case of multiple pump motors 10 operating from the one fluid supply 60 and having a common fluid summing junction 130. The fluid summing junction could be simply a common pipe or hose connection to each of the pump/motors 10 and the fluid supply 60. Such a system could be used in, for example, a vehicular transmission where individual wheels 54 or groups of wheels have separate pump/motors 10, or in an industrial system where individual conveyor belts (loads) or winches (loads) have separate pump/motors 10. In these and other applications the loads 54 may have individual torque requirements that vary rapidly and independently.

Systems with multiple pump/motors 10 such as the one shown in FIG. 5 operate in the same way as described above but have an additional capability. This is the capability to transfer flow from one pump/motor into another. The fluid volumes can be separately calculated by the sequence modulators 96 and transferred using the communication influences. The fluid supply aggregates the net or arithmetic sum of the flow quanta accepted and rejected by each pump/motor 10 and adjusts its output so that the fluid junction 130 input and output flows match. The fluid supply 60 has only to supply the net energy added or subtracted to all loads taken as a whole. In many applications this will save energy by reducing the fuel or electricity required to power the fluid supply 60.

The fluid supply 60 could adjust its flow to the fluid summing junction 130 by determining the total volume of fluid required from the quanta size and number, and providing the appropriate number and size of quanta itself. Where the fluid supply 60 is not able to or it is not desired to supply the fluid in quanta, the supply 60 could average the net volume of the quanta accepted and rejected over a suitable time period to determine a fluid flow rate to the summing junction 130.

Where the total energy ejected by the loads exceeds the total energy accepted, there will be a net outflow of energy (and fluid) into the fluid supply 60. The fluid supply 60 may be able to store this energy for later use for example in an accumulator or flywheel, or may dissipate the energy for example in a pressure relief valve or throttle valve arrangement.

Initiating the Sequence Modulation

Depending on the application, there are several possible events that could trigger the sequence modulation, some of which are described below:

In a vehicle traction control application, when any one or more of the sensors indicate an undesirable vehicle movement has occurred or is about to occur, the sequence modulator can initiate sequence modification according to one of the methods mentioned above herein. This will almost instantaneously alter the volume of the fluid quanta accepted or rejected by the pump/motor. The additional or missing quanta impart greater or lesser energy to each wheel, causing them to provide greater or lesser torque than they would have done had the controlling pulse sequence not been adjusted. A specific example of this occurs when a wheel speed sensor detects that the velocity of a wheel providing forward tractive torque increases too quickly during acceleration, possibly because the friction limit of the road surface and tyre combination has been exceeded. The sequence modulator would use one of the above methods to reduce the wheel torque, which will reduce the wheel speed and regain traction. The fluid supply could be informed of the alteration of the number and size of the fluid quanta accepted thereby to allow it to modify its output appropriately.

A second specific example occurs when the vehicle stability control computer finds a difference between the driver's intended travel direction and velocity as indicated by the steering yaw sensor, brake pressure input, accelerator pedal position and wheel speed sensors, and the vehicle's response sensed via lateral acceleration, yaw and individual wheel speed sensors. When the system detects that the measured intention is different to the measured response, modulation can be initiated in specific wheels so as to create traction forces acting on the vehicle to correct the difference. The modulation may also be accompanied by the reduction or increase of prime mover power and/or the operation of the mechanical brakes on individual driven or non-driven wheels. The system may transfer quanta of energy from left to right wheels or front to back wheels or a combination of them such that a restoring moment can be created rapidly without requiring the fluid pressure source to respond rapidly.

Because fluid quanta can be transferred between machines, it is possible for the system to provide control of the vehicle trajectory by transferring energy from left to right or front to back even when the pressure supply is temporarily not capable of providing fluid, for instance because the prime mover of the fluid supply is stopped.

A sophisticated vehicle stability control computer could examine the trend in one or more sensors and predict when an undesirable situation is about to happen, and initiate the sequence modification before that occurs.

In the application of the invention to the driving of an electric generator itself connected to an electrical distribution network or 'grid', a voltage, current or frequency sensor may detect the presence of grid voltages or frequencies not conforming to the required specification. In a specific example, a sensor may detect that the normally sinusoidally varying voltage output from the generator is not sinusoidal, having instead flattened peaks caused by the drawing of high currents at said peaks as is often the case where rectifying electrical loads are connected to the grid. By means of the invention, the modulating controller can increase the torque within a motoring stroke at the time of the peaks so as to maintain the required rotational speed profile, and therefore the required sinusoidally varying voltage profile. The modulating controller would typically employ an adaptive element that adjusts over several cycles to the amount of peak flattening, and adjusts the corrective modulation until the peak is properly sinusoidal.

In the application of the invention to the conversion of fluid kinetic energy to hydraulic energy through the means of blades such as those of a wind or water turbine, propeller or impeller, sequence modulation may be initiated as a result of characteristics of signals received from accelerometers measuring blade vibrations, the torque on the machine shafts or blade roots, the pitch of the blade, the position of points on the blade relative to other parts of the blade or device, the fluid velocity and blade velocity. A first specific example is where the specific resonant frequencies of the blades are known a priori. The sequence of cylinder actuations generated by the sequence generator can be monitored so as to infer the frequency characteristics of the torque applied to the blades, shortly before said torque is actually applied. Where the sequence is predicted to excite a specific undesirable resonance in the blades, the modulating controller can introduce an anti-phase torque modulation of the same amplitude to prevent or reduce the amplitude of the resonance. A second specific example of this occurs when accelerometers attached to the blades at certain points, said points being anti-nodes of undesirable vibratory modes of the blade, detect and quantify a vibratory resonance present or developing on the blade. The modulating controller may then add a high frequency torque component in anti-phase with the resonance and of the correct amplitude on top of the shaft torque being applied due to the normal operation, utilising the new high frequency and low latency capabilities of the invention for the most rapid vibration cancellation. A third specific example of this is the same as the second, but that the detection and quantification of the undesirable vibration can be detected by measuring the relative position of the anti-nodes using a sensor indicating the relative position of the anti-nodes compared to a reference point such as the shaft or blade attachment point.

From the above, it will be appreciated that the present invention may be employed in a number of control situations and may also be employed in control situations from which hitherto such hydraulic pump/motors have been excluded.

It will also be appreciated that invention has particular reference to machines where the at least one working chamber comprises a cylinder in which a piston is arranged to reciprocate, but its use with at least one chamber delimited by a flexible diaphragm or a rotary piston is also possible.

Still further, it will be appreciated that the present invention provides a method and apparatus for controlling controllable parameters at a higher frequency or lower latency than might be possible with the arrangements of the prior art.

Still further, it will be appreciated that the present invention may allow a pump/motor that is already being employed to drive a transmission system to be modified in accordance with the present invention and replace other more expensive components which are presently added to an already existing hydraulic pump/motor system.

Figure 4:
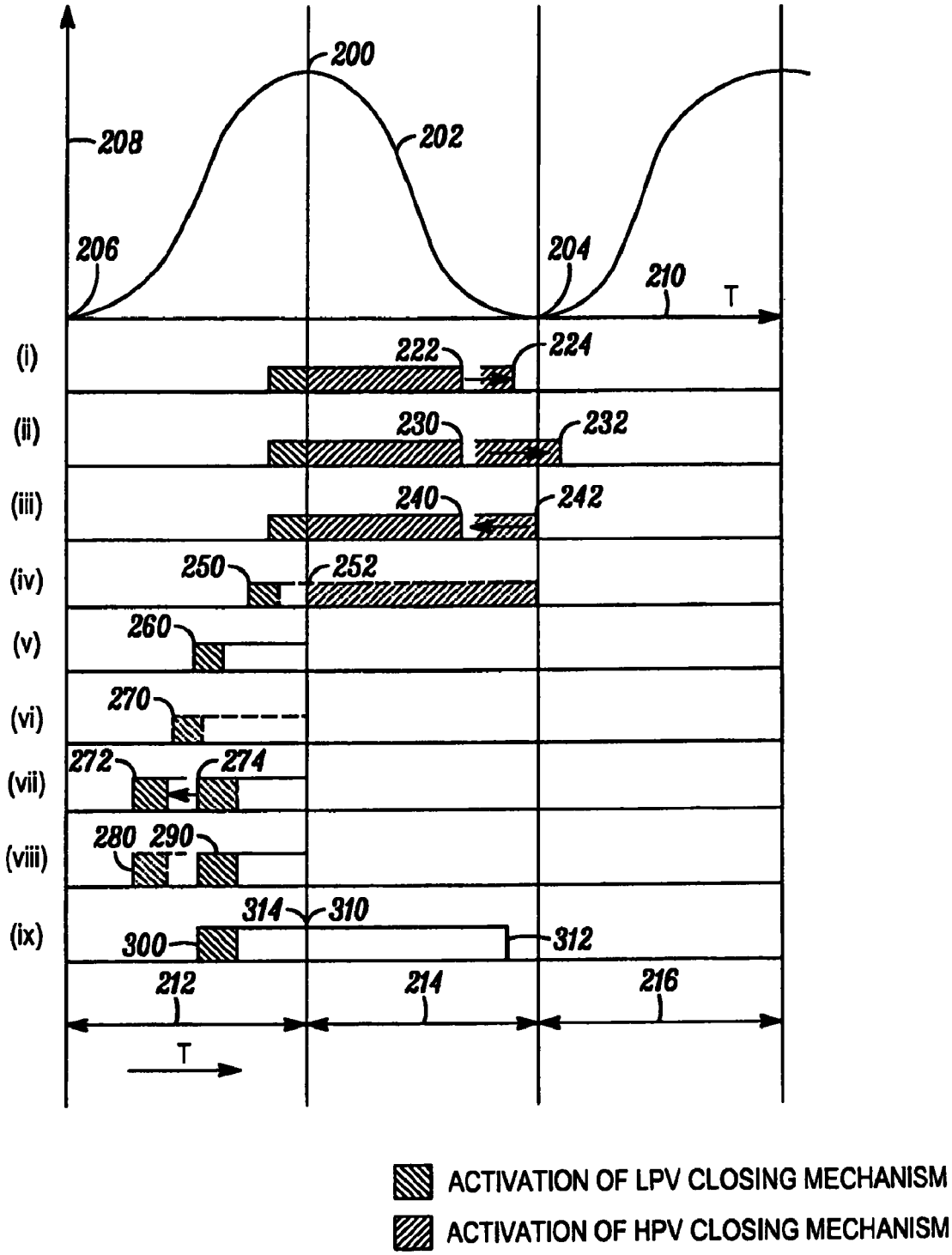
FIG. 4 illustrates the modulation effect on a given motoring/pumping cycle.

It will also be appreciated that the source of pressurised fluid 60 may be a pump of the type described herein and, indeed, in some applications of the present invention may be a pump/motor 10 provided as an additional pump/motor as shown in FIG. 4.

The invention claimed is:

1. A method of controlling a fluid working machine having:

at least one working chambers of varying cycle volume said volume varying at a first frequency;

a high pressure inlet manifold;

at least one inlet valves between said high pressure inlet manifold and said at least one working chamber;

a low pressure outlet manifold:

at least one outlet valves between said low pressure outlet manifold and said at least one working chamber;

a rotating shaft driven by or driving a load; and a controller for receiving data on a first changeable parameter, said first parameter having a latency, and controlling at least one of opening and closing sequence of at least one of said valves to selectively enable said at least one working chamber separately on each cycle of said chamber, so as to supply or accept fluid in accordance with said first changeable parameter, the method comprising the steps of:

monitoring a second changeable parameter requiring control at a frequency higher than said first frequency or having a latency lower than the latency of said first changeable parameter; and modifying said at least one of the opening and closing sequences of at least one of said valves to supply or accept fluid in accordance with a combination of said first and said second changeable parameter, wherein said at least one of said opening and closing sequences is altered during said cycle.

2. A method as claimed in claim 1 wherein said first changeable parameter is controlled on a stroke-by-stroke basis.

3. A method as claimed in claim 1 wherein said second changeable parameter is controlled at a speed greater than a stroke-by-stroke basis.

4. A method as claimed in claim 1 in which said control according to said second changeable parameter is effected so as to adjust the torque applied to an output from said fluid working machine.

5. A method as claimed in claim 1 in which said control according to said second changeable parameter is effected so as to adjust the flow rate of fluid intake or output of said fluid working machine.

6. A method as claimed in claim 1 where the sequence alteration is effected by altering a signal given to at least one of the valves in at least one of the following ways:

delaying in time a signal to close the at least one inlet valve so as to close the at least one inlet valve later but still before bottom dead center (BDC) of the at least one working chamber and thereby intake a larger volume of fluid from the high pressure manifold;

delaying in time a signal to close the at least one inlet valve so as to close the at least one inlet valve shortly after BDC so as to prevent decompression of the working chamber so as to prevent opening of the at least one outlet valve so as to cause the inducted fluid from the high pressure manifold to be returned to said manifold;

advancing in time a signal to close the at least one inlet valve so that the at least one inlet valve closes after the beginning fluid intake from the high pressure manifold but before it was intended to close by the controller and thereby intake a smaller volume of fluid from the high pressure manifold;

deleting a signal to open the at least one inlet valve so that no fluid is inducted therethrough;

adding a signal to close the at least one outlet valve where such added signal was not already commanded so as to insert an additional pumping cycle into the sequence and pump fluid to the high pressure manifold;

deleting a signal to close the at least one outlet valve so as to remove a pumping cycle or motoring cycle from the sequence;

advancing in time a signal to close the at least one outlet valve so as to pump a larger fraction of the working chamber volume to the high pressure manifold;

delaying in time a signal to close the at least one outlet valve so as to pump a smaller fraction of the working chamber volume to the high pressure manifold; and delaying in time a signal to close the at least one inlet valve so as to cause a quantity of fluid from the high pressure manifold to be returned to the working chamber.

7. A method as claimed in claim 1 and including the step of communicating the sequence alteration or the effect of the sequence alteration on hydraulic flow or shaft torque to an external device.

8. A method as claimed in claim 7 and including the step of modifying the operation of said external device in accordance with the communicated sequence alteration.

9. A method as claimed in claim 1 including the step of predicting the demand to be supplied by said fluid working machine and initiating modulation in advance of a predicted need for said modulation.

10. A method as claimed in claim 1 including the step of monitoring a second changeable parameter associated with control of wheel or track slippage of a vehicle or controlling the intended trajectory associated with a vehicle.

11. A method as claimed in claim 10 wherein said second changeable parameter is one or more of: steering wheel angle; yaw rate; acceleration; wheel velocity; wheel angular acceleration; wheel slip; vehicle lateral acceleration; vehicle velocity and brake line pressure.

12. A method as claimed in claim 10 wherein said second changeable parameter includes one or more of: vehicle roll rate and acceleration; vehicle pitch rate and acceleration; braking force applied at each wheel; tyre air pressure; vehicle acceleration and deceleration; payload mass and distribution thereof.

13. A method as claimed in claim 1 including the step of monitoring a second changeable parameter associated with a generator drive system.

14. A method as claimed in claim 13 including the step of monitoring a changeable parameter comprising one or more of: power factor, frequency, current or voltage harmonic frequency content.

15. A method as claimed in claim 1 including the step of monitoring a second changeable parameter associated with vibration of the load.

16. A method as claimed in claim 15 wherein said load comprises a fluid turbine and said second changeable parameter is selected from one or more of: position, velocity or acceleration of a point on the turbine; shaft torque; blade pitch; blade velocity; and fluid velocity.

17. A fluid working machine having:

at least one working chambers of varying cycle volume, said volume varying at a first frequency;

a high pressure inlet manifold;

at least one inlet valves between said high pressure manifold and said at least one working chamber;

a low pressure outlet manifold;

at least one outlet valves between said low pressure manifold and said at least one working chamber;

a rotating shaft driven by or driving a load;

a controller for receiving data on a first changeable parameter, said first parameter having a latency and controlling the at least one of opening and closing sequence of at least one of said valves to selectively enable said at least one working chambers separately on each cycle of the said at least one chambers, so as to supply or accept fluid in accordance with said first changeable parameter, a monitor for monitoring a second changeable parameter requiring control at a frequency higher than said first frequency or having a latency lower than the latency of said first changeable parameter; wherein said controller is configured to respond to a change in said second changeable parameter and modifies the at least one of the opening and closing sequences of at least one of the valves to supply or accept pressurized fluid in accordance with a combination of said first and said second changeable parameter, wherein said at least one of said opening and closing sequences is altered during said cycle.

18. A fluid working machine as claimed in claim 17 and including a summing device for combining said first and second changeable parameters by arithmetic summing thereof and for creating a demand signal associated with said combined demand.

19. A fluid working machine as claimed in claim 17 and including a selection device for combining said first and second changeable parameters by selecting one or other to become a complete demand.

20. A fluid working machine as claimed in claim 17 and including at least one monitor for monitoring said second changeable parameters, a modulation planner for planning a demand based on the received data on said second controllable parameters and a sequence modulator for sequencing demand to said pump in accordance with a combination of demand associated with said first and second controllable parameters.

21. A fluid working machine as claimed in claim 17 and further including multiple fluid working machines, each machine being linked to the other machines and the pressurised fluid such as to allow fluid pumped from an outlet manifold of one machine to be passed to the inlet manifold of another machine.

22. A fluid working machine as claimed in claim 17 in which said controller comprises an individual controller for monitoring both of said first and said second controllable parameters.

23. A fluid working machine as claimed in claim 17 wherein said pressurised fluid is from said outlet manifold of a further fluid working machine.

24. A fluid working machine as claimed in claim 17 and including a predictor for predicting the sequence alteration in advance of actual demand therefore and for causing the actuation of said valves to commence fluid supply control in advance of actual demand.

25. A fluid working machine as claimed in claim 17 and including one or more sensors for sensing one or more secondary parameters.

26. A fluid working machine as claimed in claim 25 wherein said secondary sensors are sensors for monitoring one or more secondary parameters associated with the control of wheel or track slippage of a vehicle or vehicle trajectory.

27. A fluid working machine as claimed in claim 25 in which said sensors comprise sensors for detecting one or more of: steering wheel angle; yaw rate; acceleration; wheel velocity; wheel angular acceleration; wheel slip; vehicle lateral acceleration; vehicle velocity and brake line pressure.

28. A fluid working machine as claimed in claim 25 wherein said secondary sensors are sensors for detecting one or more of: vehicle roll rate and acceleration; vehicle pitch rate and acceleration; braking force applied at each wheel; tyre air pressure; vehicle acceleration and deceleration; payload mass and distribution thereof.

29. A fluid working machine as claimed in claim 25 wherein said secondary sensors are sensors for detecting one or more of: power factor current and voltage harmonic content frequency.

30. A fluid working machine as claimed in claim 25 wherein said secondary sensors are sensors for detecting vibration of a load.

31. A method according to claim 1, wherein said load comprises a fluid turbine and said secondary sensors are sensors for detecting one or more of: position, velocity or acceleration of a point on the turbine; shaft torque; blade pitch; blade velocity; and fluid velocity.

* * * * *